US007833471B2

(12) United States Patent
Tachisato et al.

(10) Patent No.: US 7,833,471 B2
(45) Date of Patent: Nov. 16, 2010

(54) CARBURIZING APPARATUS AND CARBURIZING METHOD

(75) Inventors: Showa Tachisato, Tenri (JP); Ryosuke Yamamoto, Tenri (JP)

(73) Assignee: Koyo Thermo Systems Co., Ltd., Osaka-shi (JP)

( * ) Notice: Subject to any disclaimer, the term of this patent is extended or adjusted under 35 U.S.C. 154(b) by 599 days.

(21) Appl. No.: 11/661,000

(22) PCT Filed: Aug. 23, 2004

(86) PCT No.: PCT/JP2004/012062

§ 371 (c)(1),
(2), (4) Date: Feb. 23, 2007

(87) PCT Pub. No.: WO2006/021984

PCT Pub. Date: Mar. 2, 2006

(65) Prior Publication Data

US 2007/0295428 A1 Dec. 27, 2007

(51) Int. Cl.
*C23C 8/20* (2006.01)

(52) U.S. Cl. ..... 266/252; 266/249

(58) Field of Classification Search ..... 266/249, 266/252, 44

See application file for complete search history.

(56) References Cited

U.S. PATENT DOCUMENTS

| | | | | |
|---|---|---|---|---|
| 4,627,814 | A | 12/1986 | Hattori et al. | |
| 5,868,871 | A * | 2/1999 | Yokose et al. | 266/252 |

FOREIGN PATENT DOCUMENTS

| | | |
|---|---|---|
| JP | 60-004566 | 1/1985 |
| JP | 61-027485 | 2/1986 |
| JP | 63-045358 | 2/1988 |
| JP | 63-145854 | 9/1988 |
| JP | 3-202456 | 9/1991 |
| JP | 4-285152 | 10/1992 |
| JP | 8-222421 | 8/1996 |
| JP | 10-53809 | 2/1998 |
| JP | 2001-220659 | 8/2001 |

* cited by examiner

*Primary Examiner*—Scott Kastler
(74) *Attorney, Agent, or Firm*—Jordan and Hamburg LLP

(57) ABSTRACT

A carburizing apparatus that can reduce cost and shorten the carburizing time is provided. A single coil for raising temperature, a plurality of coils for soaking, and a conveying mechanism that conveys a treatment object from a position of induction heating with the coil for raising temperature to positions of induction heating with the coils for soaking are provided inside a container for carburization treatment. The rated capacity of a power source for raising temperature that is connected to the coil for raising temperature is higher than the rated capacity of a power source for soaking connected to the coil for soaking.

3 Claims, 4 Drawing Sheets

〔Fig. 1〕
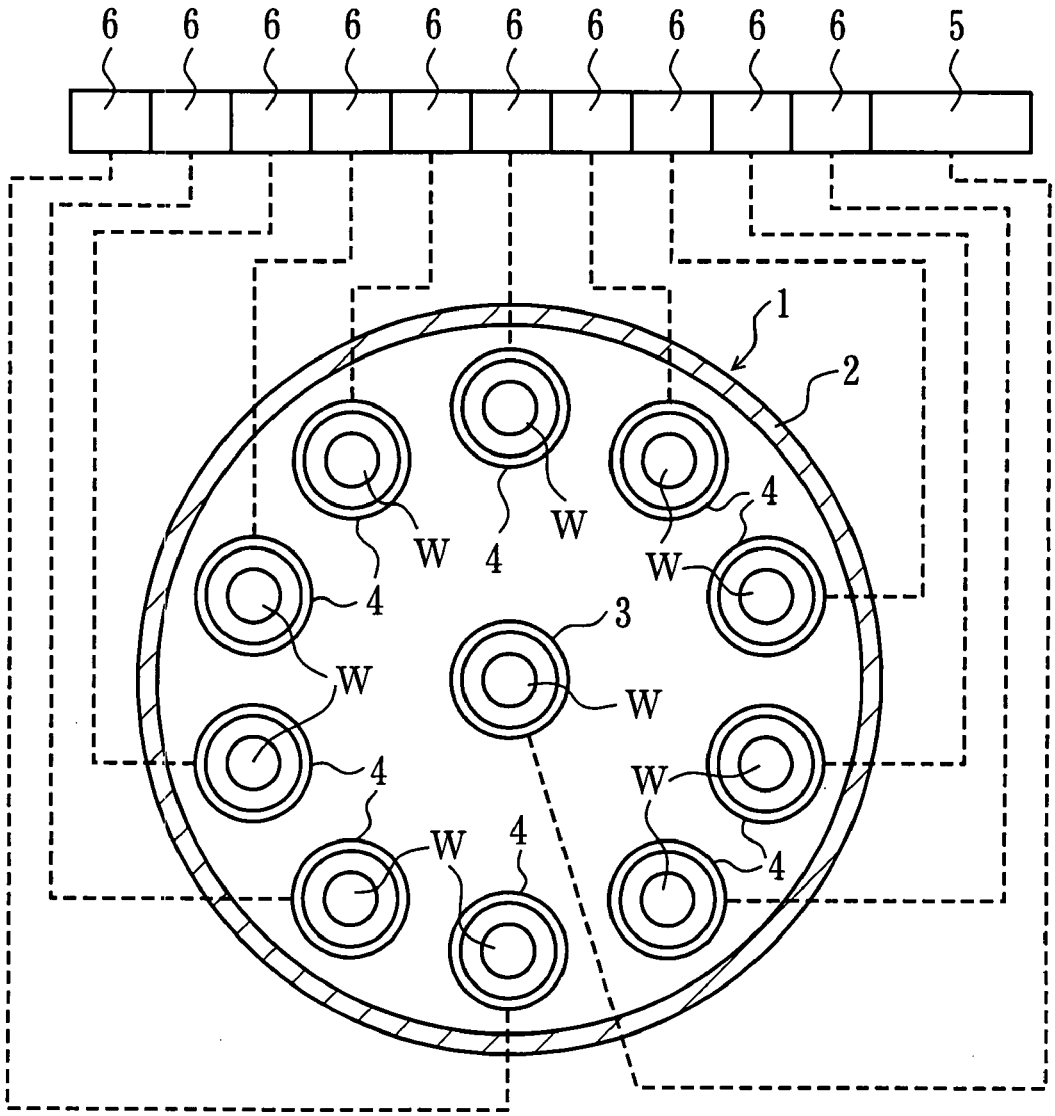

〔Fig. 2〕
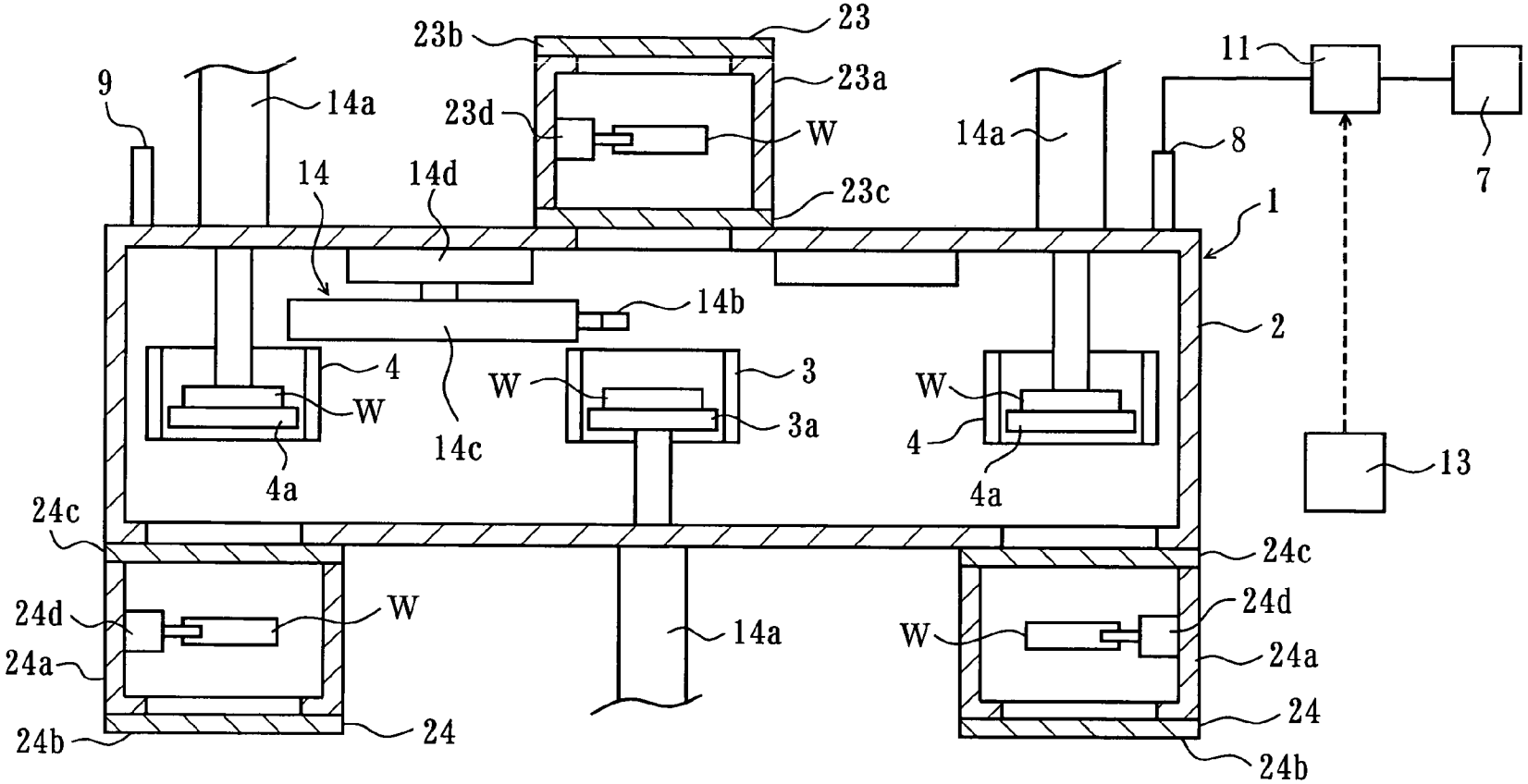

〔Fig. 3〕
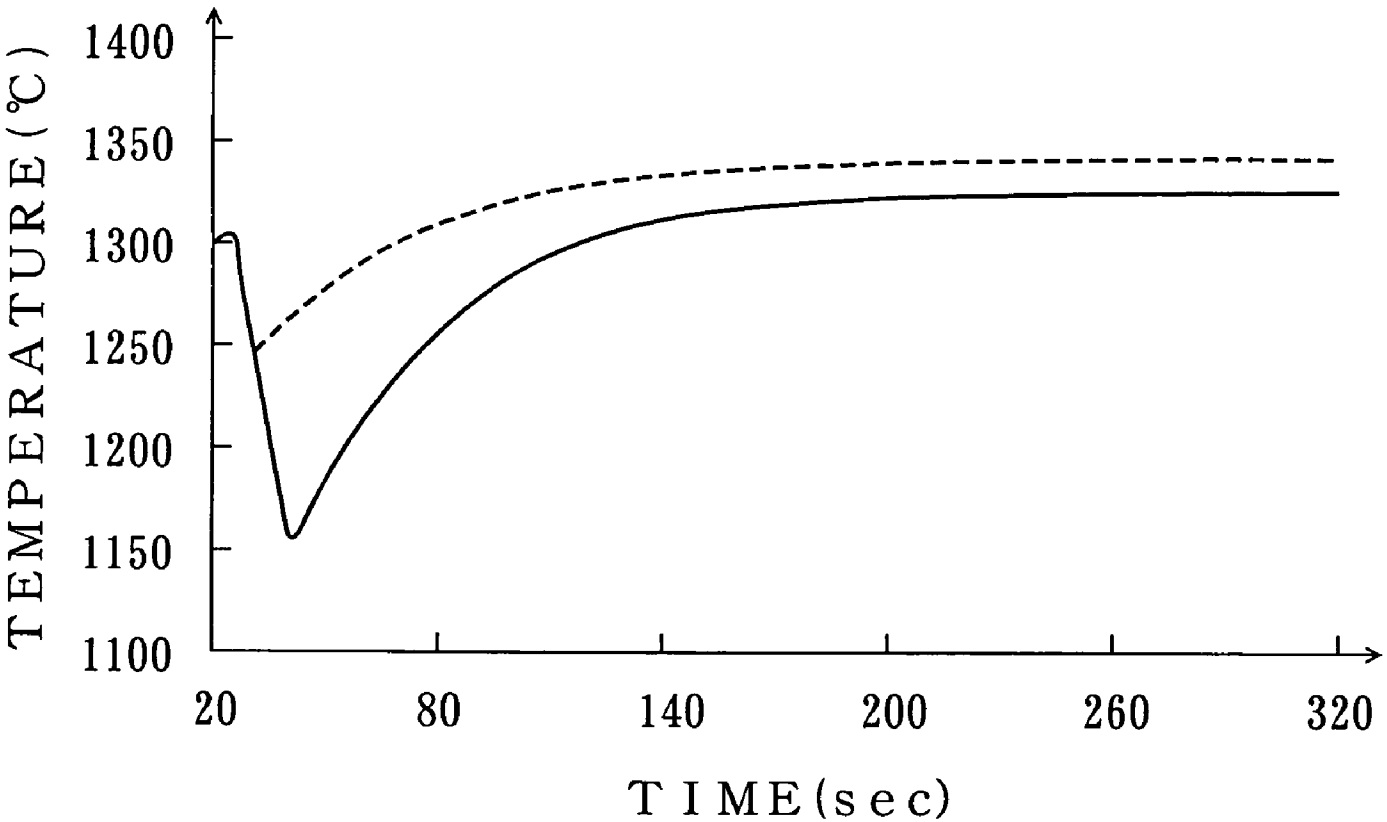

〔Fig. 4〕
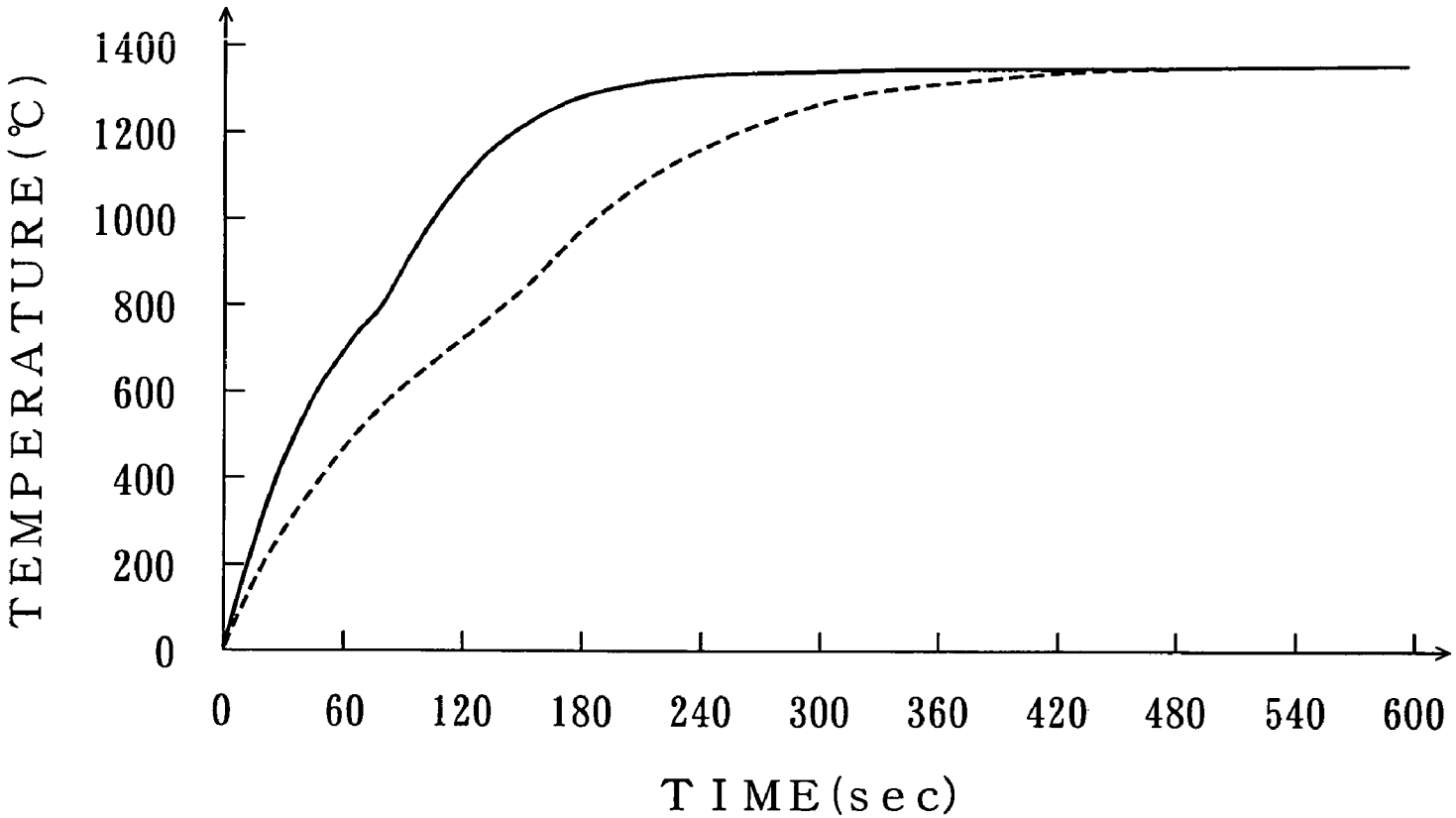

CARBURIZING APPARATUS AND CARBURIZING METHOD

BACKGROUND OF THE INVENTION

The present invention relates to an apparatus and a method suitable for performing carburization of steel parts for use, for example, in automotive industry and/or machinery industry.

In order to rapidly raise the temperature of a treatment object to a carburizing temperature when the treatment object is induction heated in a carburizing apparatus, a power source having high rated capacity has to be connected to the induction heating coil. In particular, the power source capacity has to be increased to raise the carburizing temperature in order to shorten the carburizing time. However, power sources having high rated capacity are large and expensive; therefore if the number of coils is increased to increase the throughput, the number of power source and the installation space are increased and the manufacturing and/or installation cost of carburizing apparatus increases.

Accordingly, it is suggested to use a carburizing apparatus in which a treatment object is heated to a carburizing temperature in a preheating chamber, treatment objects are maintained at a carburizing temperature by induction heating in a plurality of carburizing chambers, then carburization is carried out (see Patent Document 1). The carburizing time thus can be shortened by continuously treating a plurality of treatment objects.

Patent Document 1: Japanese Patent Application Laid-open No. 10-53809

However, in the conventional carburizing apparatus, doors are provided so as to be opened and closed between the preheating chamber and each carburizing chamber, the doors are closed after the treatment object heated to the carburizing temperature in the preheating chamber is conveyed into the carburizing chamber, then gas for carburizing atmosphere is caused to flow at a set flow rate into the carburizing chamber, and then the electric current is passed through the coil in the carburizing chamber, thereby heating the treatment object. As a result, the interval from the completion of heating of the treatment object in the preheating chamber to the start of carburization in the carburizing chamber is increased, so that the drop in temperature of the treatment object during this interval is increased. The resultant problem is that a long interval is required to heat the treatment object again to the carburizing temperature in the carburizing chamber and the carburizing time cannot be sufficiently shortened.

Furthermore, in a case where the treatment object has magnetic properties when the induction heating is started in the carburizing chamber, if the temperature of the treatment object becomes less than the Curie point, a mechanism is necessary to prevent the treatment object from jumping up under the effect of electro-magnetic force when the electric current is passed through the coil in the carburizing chamber. A problem resulting from providing such jumping preventing mechanism in each of a plurality of carburizing chambers is that the structure of the apparatus becomes complex and the manufacturing cost increases.

It is an object of the present invention to provide a carburizing apparatus and a carburizing method that can resolve the above-described problem.

SUMMARY OF THE INVENTION

The carburizing apparatus in accordance with the present invention comprises a container for carburization treatment, a single coil for raising temperature that is provided inside the container, a plurality of coils for soaking that are provided inside the container, a power source for raising temperature that is connected to the coil for raising temperature, power sources for soaking that are connected to the coils for soaking, and a conveying mechanism that conveys a treatment object from a position of induction heating with the coil for raising temperature to positions of induction heating with the coils for soaking inside the container, wherein the rated capacity of the power source for raising temperature is higher than the rated capacity of the power source for soaking.

In accordance with the present invention, when a plurality of treatment objects are maintained at a high carburizing temperature concurrently by using the single power source for raising temperature and the plurality of power sources for soaking, the single coil for raising temperature and the plurality of coils for soaking are provided in the single container; therefore the time required for conveying the treatment object from the position of induction heating with the coil for raising temperature to the position of induction heating with the coil for soaking can be shortened. As a result, the interval from the end of induction heating with the coil for raising temperature to the start of induction heating with the coil for soaking can be shortened, and the drop in temperature of the treatment object in the interval can be prevented. As a result, the power source cost can be reduced, and the treatment object can be conveyed rapidly to shorten the time required for the carburization treatment.

It is preferred that a flow rate control mechanism for controlling flow rate of gas for carburizing atmosphere that is supplied into the container is provided, and the flow rate of the gas for carburizing atmosphere is controlled by the flow rate control mechanism so that the gas for carburizing atmosphere flows constantly at a set flow rate inside the container from a point of time when the treatment object is carried into the container to a point of time when the treatment object is carried out of the container. As a result, the gas for carburizing atmosphere flows constantly at the set flow rate inside the single container, so that the concentration of the gas for carburizing atmosphere inside the container can be maintained at a desired level from the start of induction heating of the treatment object with the coil for raising temperature to the end of induction heating with the coil for soaking. Therefore, the interval from the end of induction heating with the coil for raising temperature to the start of induction heating with the coil for soaking can be shortened, so that the drop in temperature of the treatment object in the interval can be prevented. As a result, the power source cost can be reduced, and the treatment object can be conveyed at a high speed so that the time required for the carburization treatment can be shortened.

According to the carburizing method of the present invention, when a treatment object made from magnetic material is subjected to carburization treatment by the carburizing apparatus of the present invention, the temperature of the treatment object made from magnetic material is raised to a carburization temperature that exceeds the Curie point with the coil for raising temperature, and then, before the temperature of the treatment object that is conveyed to a position of induction heating with the coil for soaking from the position of induction heating with the coil for raising temperature becomes below the Curie point, a process of passing electric current through the coil for soaking is started.

By using the carburizing apparatus of the present invention, the interval from the end of induction heating with the coil for raising temperature to the start of induction heating with the coil for soaking can be shorted, so the drop in temperature of the treatment object during the interval can be prevented. As a result, the treatment object made from magnetic material can be maintained at a temperature equal to or higher than the Curie point when the process of passing electric current through the coil for soaking is started, and the treatment object can be prevented from jumping up under the effect of electro-magnetic force when the induction heating with the coil for soaking is started. Therefore, there is no need to provide a mechanism for preventing the treatment object from jumping up in the positions of induction heating with the coils for soaking.

According to the carburizing apparatus and carburizing method of the present invention, the cost can be reduced and carburizing time can be shortened.

BRIEF DESCRIPTION OF THE DRAWINGS

[FIG. 1] A plan sectional view for explaining the configuration of a gas carburizing apparatus of induction heating type of an embodiment of the present invention

[FIG. 2] A side sectional view for explaining the configuration of the gas carburizing apparatus of induction heating type of the embodiment of the present invention

[FIG. 3] An illustration of the relationship between temperature, time, and heating halt period of the treatment object, in which the heating is halted temporarily

[FIG. 4] An illustration of the relationship between temperature, time, weight, and power capacity of the power sources for heating when the treatment object is heated

EXPLANATION OF REFERENCE SYMBOLS

1 gas carburizing apparatus of induction heating type
2 container
3 coil for raising temperature
4 coil for soaking
5 power source for raising temperature
6 power source for soaking
10 flow rate control mechanism
14 conveying mechanism

DETAILED DESCRIPTION OF THE INVENTION

A gas carburizing apparatus 1 of induction heating type shown in FIG. 1 and FIG. 2 comprises a cylindrical container 2 for carburization treatment. A single coil 3 for raising temperature and a plurality (ten in the present embodiment) of coils 4 for soaking are provided inside the container 2. The coil 3 for raising temperature is connected to a power source 5 for raising temperature, and the coils 4 for soaking are connected to power sources 6 for soaking respectively. The rated capacity of the power source 5 for raising temperature is higher than the rated capacity of the power source 6 for soaking. It is preferred that the rated capacities of the power source 5 for raising temperature and power source 6 for soaking are necessary minimum. For example, the rated capacity of the power source 5 for raising temperature is taken as 100 kW, and the rated capacity of the power source 6 for soaking is taken as 10 kW. The number "N" of coils 4 for soaking can be determined based on the treatment time "t" that is required to treat a treatment object W and the target treatment cycle "T" of the treatment object W as $N \geqq t/T$.

Gas for carburizing atmosphere that is supplied from a gas source 7 is supplied from an inlet port 8 into the container 2 and discharged from a exhaust port 9. The carburizing atmosphere is comprised of carburizing gas and dilution gas. No specific limitation is placed on the type of the carburizing gas and dilution gas. For example, the carburizing gas can be methane gas and the diluting gas can be nitrogen gas. The carburizing atmosphere may be comprised of the carburizing gas only.

A flow rate control mechanism 10 for controlling flow rate of the gas for carburizing atmosphere supplied into the container 2 comprises an electromagnetic flow rate control valve 11 provided between the gas source 7 and inlet port 8 and a controller 13 connected to the flow rate control valve 11. The controller 13 controls the flow rate of the gas for carburizing atmosphere by controlling the electromagnetic flow rate control valve 11 according to a set flow rate, whereby the gas for carburizing atmosphere is caused to flow at the set flow rate in the container 2, and the concentration of the gas for carburizing atmosphere can be maintained at a desired level. The gas for carburizing atmosphere flows at a constant flow rate of, for example, 5 L/min according to the throughput and size of the container 2, and the total pressure of the carburizing atmosphere is maintained at, for example, about atmospheric pressure.

A conveying mechanism 14 for conveying the treatment object W from the position of induction heating with the coil 3 for raising temperature to the positions of induction heating with the coils 4 for soaking is provided inside the container 2. No specific limitation is placed on the layout and structure of the conveying mechanism 14, and a known conveying mechanism can be used. For example, it can be comprised of lifting devices 14*a* for lifting and lowering support stands 3*a*, 4*a* each of which support the treatment object W in the position of induction heating with each of the coils 3, 4, a holding unit 14*b* such as a fork or robot hand for holding the treatment object W, and a movement mechanism 14*c* for moving the holding unit 14*b* in the circumferential direction around the coil 3 for raising temperature and in the transverse direction. A mechanism for preventing the treatment object W from jumping up (not shown in the figures) is provided on the support stand 3*a* for supporting the treatment object W at the position of induction heating with the coil 3 for raising temperature. A conventional jumping preventing mechanism can be used for this purpose.

A carry-in device 23 is provided in the center of the upper surface of the container 2, and carry-out devices 24 the number of which is equal to the coils 4 for soaking are provided in the vicinity of the circumferential edge of the lower surface of the container 2.

The carry-in device 23 has a cylindrical body 23*a*, a door 23*b* for an upper inlet port of the body 23*a*, a door 23*c* for a connection port between the lower section of the body 23*a* and the container 2, and a holding unit 23*d* for holding the treatment object W in the body 23*a*. The treatment object W that is introduced into the body 23*a* from the upper inlet port by a conventional external conveyor or the like (not shown in the figure) is held by the holding unit 23*d*, then it is supported by the holding stand 3*a* that is lifted into the body 23*a* via the connection port from the container 2, and it is located in the position of induction heating with the coil 3 for raising temperature by lowering the support stand 3*a*.

Each carry-out device 24 has a cylindrical body 24*a*, a door 24*b* for a lower outlet port of the body 24*a*, a door 24*c* for a connection port between the upper section of the body 24*a* and the container 2, and a holding unit 24*d* for holding the treatment object W in the body 24*a*. The treatment object W that is carried into the body 24*a* via the connection port from the position of induction heating with the coil for 4 soaking by lowering the support stand 4*a* is held by the holding unit 24*d*, and then it is carried out to the outside of the body 24*a* via the outlet port by a conventional external conveyor or the like (not shown in the figure).

The inside of the bodies 23*a*, 24*a* of the carry-in device 23 and each carry-out device 24 can be purged with a purge mechanism (not shown in the figures). The conventional purging mechanism can be used, for example, a mechanism performing vacuum purging can be employed.

No specific limitation is placed on the positions of the carry-in device 23 and carry-out devices 24, for example, they may be disposed beside the container 2, and the treatment object W can be carried into the container 2 or carried out of the container 2 by moving the treatment object in the lateral direction with the conveying mechanism 14. Furthermore, no limitation is placed on the structure of the carry-in device 23 and carry-out devices 24. Furthermore, in the case where the purging time of the body 23*a* of the carry-in device 23 is longer than the temperature rise time of the treatment object W with the coil 3 for raising temperature, a plurality of carry-in devices 23 may be provided.

When a treatment object W made from magnetic material is carburized by the carburizing apparatus 1, the inside of the container 2 is filled with the gas for carburizing atmosphere having a preset concentration. Therefore, the flow rate of the gas for carburizing atmosphere is controlled by the flow rate control mechanism 10 so that the gas for carburizing atmosphere flows constantly at the set flow rate in the container 2 from the point of time when the treatment object W is carried into the container 2 to the point of time when the treatment object W is carried out of the container 2. The door 23*b* is then opened with keeping the door 23*c* closed, and the treatment object W is introduced into the body 23*a* of the carry-in device 23. Then, the door 23*b* is closed, and the inside of the body 23*a* is purged with holding the treatment object W by the holding unit 23*d*. For example, vacuum purging or gas purging with the gas for carburizing atmosphere is performed. When the vacuum purging is performed, after the purging has been completed, the pressure inside the body 23*a* is restored by backfilling with the gas for carburizing atmosphere, the pressure of which is same as that in the container 2. The door 23*c* is then opened, and the treatment object W released from the holding unit 24*d* is supported by the support stand 3*a* that is lifted into the body 23*a*. The support stand 3*a* is then lowered, and the door 23*c* is closed, the treatment object W is thus carried into the container 2. After the door 23*c* has been closed, the inside of the body 23*a* is purged. For example, vacuum purging or gas purging with nitrogen gas or the like can be performed. In a case where the vacuum purging is performed, after the purging has been completed, the pressure inside the body 23*a* is restored by backfilling with nitrogen gas or the like, the pressure of which is equal to the atmospheric pressure. The next treatment object W is thereafter introduced in a similar manner. After the treatment object W carried into the container 2 is located in the position of induction heating with the coil 3 for raising temperature, the treatment object W made from magnetic material is induction heated to a prescribed carburizing temperature exceeding the Curie point by passing an electric current through the coil 3 for raising temperature. The treatment object W is fixed by the jumping preventing mechanism so as to be prevented from jumping up at the support stand 3*a* when the electric current is passed through the coil 3 for raising temperature. The treatment object W heated to the carburizing temperature is conveyed by the conveying mechanism 14 from the position of induction heating with the coil 3 for raising temperature to the position of induction heating with the coil 4 for soaking. For example, the support stand 3*a* is moved above the coil 3 for raising temperature, the fixing by the jumping preventing mechanism is released, the treatment object W located on the support stand 3*a* is held by the holding unit 14*b*, the treatment object W is disposed on the support stand 4*a* positioned above any of the coils 4 for soaking by the movement mechanism 14*c*, the treatment object W released from the holding unit 14*b* is supported by the support stand 4*a*, and then the support stand 4*a* is lowered, whereby the treatment object W is located in a position of induction heating with the coil 4 for soaking. It is preferred that the conveying by the conveying mechanism 14 is preformed as fast as possible, for example, within 15 sec or less. The treatment object W is then induction heated, by starting a process of passing the electric current through the coil 4 for soaking before the temperature of the treatment object made from magnetic material becomes below the Curie point. In the present embodiment, no temperature control is performed by fixing the output from the power sources 6 for soaking into the coils 4 for soaking, but such temperature control may be conducted. After the carburization of the treatment object W soaked at the desired carburizing temperature with the coil 4 for soaking has been completed, the door 24*c* of the carry-out device 24 is opened, and the treatment object W supported by the support stand 4*a* that is lowered from the container 2 into the body 24*a* is held by the holding unit 24*d*. After the support stand 4*a* has been lifted into the container 2, the door 24*c* is closed, and the treatment object W is cooled in the body 24*a*. A cooling unit of air cooling type or the like may be provided for performing the forced cooling of the treatment object W in the body 24*a*. The door 24*b* is then opened and the treatment object W is carried out from the body 24*a*.

According to the gas carburizing apparatus 1 of induction heating type, when a plurality of treatment objects W are maintained at a high carburizing temperature concurrently by using the single power source 5 for raising temperature and the plurality of power sources 6 for soaking, the single coil 3 for raising temperature and the plurality of coils 4 for soaking are provided inside the single container 2, and the gas for carburizing atmosphere flows constantly at a set flow rate inside the container 2; therefore, the concentration of the gas for carburizing atmosphere inside the container 2 can be maintained at the desired level from the start of induction heating of the treatment object W with the coil 3 for raising temperature to the end of induction heating with the coils 4 for soaking. As a result, the time required for conveying the treatment object from the position of induction heating with the coil 3 for raising temperature to the position of induction heating with the coil 4 for soaking can be shortened, so the interval from the end of induction heating with the coil 3 for raising temperature to the start of induction heating with the coil 4 for soaking can be shortened, and the drop in temperature of the treatment object W in this interval can be prevented. Therefore, the power source cost can be reduced, and the treatment object W can be conveyed rapidly to shorten the time required for the carburization treatment. Furthermore, the drop in temperature of the treatment object W in the interval from the end of induction heating with the coil 3 for raising temperature to the start of induction heating with the coil 4 for soaking can be prevented, so that the treatment object W made from magnetic material can be maintained at a temperature equal to or higher than the Curie point when the process of passing electric current through the coil 4 for soaking is started, and the treatment object W can be prevented from jumping up under the effect of electro-magnetic force when the induction heating with the coil 4 for soaking is started. As a result, there is no need to provide a mechanism for preventing the treatment object W from jumping up in the positions of induction heating with the coils 4 for soaking.

FIG. 3 shows the relationship between the temperature of a treatment object W and time, in which a steel outer ring (weight 200 gram) of a bearing as the treatment object W is induction heated with the coil 3 for raising temperature, the heating is halted for a given time interval after 25 sec elapse since the temperature of the treatment object W reaches 1300° C., and then heating with the coil 4 for soaking is started at a constant output. In this relationship, the case where the heating halt time is 5 sec is shown by a broken line and the case where the heating halt time is 15 sec is shown by a solid line. The output of the coil 4 for soaking is 6.2 kW. FIG. 3 demonstrates that when the interval from the end of induction heating with the coil 3 for raising temperature to the start of induction heating with the coil 4 for soaking is short, the drop in temperature of the treatment object W is small, the recovery time to the initial heating temperature is shortened, and the final attained temperature increases, thereby confirming that the carburizing time can be shortened.

FIG. 4 shows the relationship between the temperature of a treatment object W and time, in which a steel outer ring (weight 200 gram) of a bearing and a gear (weight 470 gram) as the treatment objects W are induction heated respectively only by the coil 4 for soaking at constant output. The relationship between the temperature of the outer ring of a bearing and time in the case where the output of the coil 4 for soaking is 6.2 kW is shown by a solid line, and the relationship between the temperature of the gear and time in the case where the output of the coil 4 for soaking is 8.8 kW is shown by a broken line. The final attained temperature in this case is about 1330° C. and the time required to reach this temperature is about 8 min for both the outer ring of a bearing and the gear. However, the time required for the outer ring of a bearing to reach a temperature of 1300° C. is about 3.5 min, whereas the time required for the gear to reach a temperature of 1300° C. is about 6.5 min. Therefore, in order to shorten the carburizing time regardless of the weight of the treatment object W, it is preferred that conveying time from the end of induction heating with the coil 3 for raising temperature to the start of induction heating with the coil 4 for soaking is as short as possible, and the drop in temperature of the treatment object W during such conveying is as small as possible.

The present invention is not limited to the above-described embodiment. For example, the uniformity of quality of the treatment object W may be improved, for example, by providing a mechanism for rotating the support stands 3*a*, 4*a* around a vertical axis to rotate the treatment object W in the induction heating positions with the coil 3 for raising temperature and coils 4 for soaking. Furthermore, an atmosphere adjustment nozzle may be provided for improving the uniformity of the atmosphere by blowing the gas for carburizing atmosphere in the vicinity of the coil 4 for soaking. Moreover, no special limitation is placed on the layout of the coil 3 for raising temperature and coils 4 for soaking inside the container 2.

The invention claimed is:

1. A carburizing apparatus for carburization treatment of a treatment object in a sole chamber, comprising:

a sole container, said sole container defining a sole chamber in which the treatment object is receivable, the sole chamber comprising a preheater coil being disposed inside said sole chamber for raising the temperature of the treatment object, soaker coils being disposed inside said sole chamber for soaking the treatment object, and a conveying mechanism being disposed inside said sole chamber that is configured to convey the treatment object while the treatment object remains in said sole chamber from a position of induction heating with said preheater coil to positions of induction heating with said soaker coils;

a preheater power source which is connected to said preheater coil;

soaker power sources which are connected to said soaker coils, a rated capacity of said preheater power source being higher than a corresponding rated capacity of each of said soaker power sources; and carry-out devices, the number thereof being equal to the number of soaker coils disposed inside said sole chamber, that carry the treatment object from a position of induction heating with said soaker coils to a position outside of said sole chamber and said sole container.

2. The carburizing apparatus according to claim 1, further comprising a flow rate control mechanism controlling the flow rate of gas for carburizing atmosphere that is supplied into said sole chamber, wherein the flow rate of the gas for carburizing atmosphere is controlled by said flow rate control mechanism so that the gas for carburizing atmosphere flows constantly at a set flow rate inside said sole chamber from a point of time when the treatment object is carried into said sole chamber to a point of time when the treatment object is carried out of said sole chamber.

3. A carburizing method, wherein when a treatment object made from magnetic material is subjected to carburization treatment by the carburizing apparatus according to claim 1 or 2, the temperature of the treatment object is raised to a carburization temperature that exceeds the Curie point with said coil for raising temperature, and then, before the temperature of the treatment object that is conveyed to a position of induction heating with said coil for soaking from the position of induction heating with said coil for raising temperature becomes below the Curie point, a process of passing electric current through said coil for soaking is started.

* * * * *

UNITED STATES PATENT AND TRADEMARK OFFICE

CERTIFICATE OF CORRECTION

PATENT NO. : 7,833,471 B2
APPLICATION NO. : 11/661000
DATED : November 16, 2010
INVENTOR(S) : Showa Tachsato et al.

It is certified that error appears in the above-identified patent and that said Letters Patent is hereby corrected as shown below:

On the Title Page
The city address of the Assignee should be changed as follows:

Item (73) Assignee: Koyo Thermo Systems Co., Ltd.,
from "Osaka-shi (JP)" to --Nara (JP)--

Signed and Sealed this
Twenty-second Day of February, 2011

David J. Kappos

David J. Kappos
*Director of the United States Patent and Trademark Office*